US005090750A

United States Patent [19]

Lindqvist

[11] Patent Number: 5,090,750

[45] Date of Patent: Feb. 25, 1992

[54] LOCKING MECHANISM FOR SASH TYPE WINDOWS

[75] Inventor: Per-Olof Lindqvist, Onsala, Sweden

[73] Assignee: Fixfabriken AB, Sweden

[21] Appl. No.: 637,177

[22] Filed: Jan. 3, 1991

[51] Int. Cl.[5] ..... E05C 9/00

[52] U.S. Cl. ..... 292/7; 292/36; 292/DIG. 20; 292/DIG. 47

[58] Field of Search ..... 292/36, DIG. 47, DIG. 20, 292/7, 240, 241, DIG. 38

[56] References Cited

U.S. PATENT DOCUMENTS

| | | | |
|---|---|---|---|
| 336,302 | 2/1886 | Dudgeon | 292/36 |
| 480,148 | 8/1892 | Theby | 292/36 |
| 1,041,803 | 10/1912 | Kilburn | 292/36 |
| 1,059,999 | 4/1913 | James | 292/36 |
| 1,253,810 | 1/1919 | Gianninoto | 292/DIG. 20 |
| 1,393,628 | 10/1921 | Leichter | 292/DIG. 20 |
| 1,704,946 | 3/1929 | Lindgren | 292/36 |
| 1,901,974 | 3/1933 | Macy | 292/DIG. 20 |
| 2,537,736 | 1/1951 | Carlson | 292/DIG. 20 |
| 3,811,718 | 5/1974 | Bates | 292/DIG. 38 |

FOREIGN PATENT DOCUMENTS 2026594 2/1980 United Kingdom ..... 292/DIG. 47

*Primary Examiner*—Eric K. Nicholson

*Attorney, Agent, or Firm*—Lerner, David, Littenberg, Krumholz & Mentlik

[57] ABSTRACT

A locking mechanism for windows having upper and lower sashes slidably disposed in a window frame. In the locked position of the mechanism, locking bolts mounted on the transverse rail of one sash engage a sidewall of a guide groove in the window frame, thereby forcing that sash towards the other sash to effect a better seal between the sashes. Optionally, at least one sash clamp mounted on a transverse rail of one sash is adapted to engage a cooperating receiving element affixed to the adjacent transverse rail of the other sash. In the unlocked position of the mechanism, the sash clamp disengages the receiving element, and the locking bolts release contact with the sidewall of the guide groove while still remaining within the groove. The locking mechanism also has a release position in which the locking bolts are retracted from the guide groove to permit the sash to be moved transversely for cleaning.

20 Claims, 3 Drawing Sheets

13
6
23
24
18
16
19
20
21
25
27
29
30
34
26
35
33
4
2
1
17
B
32
22
31
28

LOCKING MECHANISM FOR SASH TYPE WINDOWS

FIELD OF THE INVENTION

The present invention relates to a locking mechanism for application on a sash type window having upper and lower sliding sashes, each sash being enclosed by a frame composed of side rails and transverse rails, the top and bottom transverse rails of the lower and upper sashes respectively forming the meeting rail of the respective sash which, when the sashes are in the closed position, abuts the adjacent rail of the other sash, said locking mechanism being attached to the top surface of the top transverse rail of the lower sash and being operable by a handle.

BACKGROUND OF THE INVENTION

Locking mechanisms for sash windows are known in which, in the closed position, the handle of the locking mechanism engages a receiving element affixed to the adjacent rail of the other window sash. Whilst such an arrangement is effective in maintaining the window closed, there is no provision for securely holding the window in an open position, i.e. if the lower sash is slid upwards, there is no positive locking means to prevent the sash sliding back down under the force of gravity.

To overcome this problem, locking mechanisms have been developed in which engagement bolts arranged at the ends of the transverse sash rail on the locking mechanism are forced into contact with a region of the frame which surrounds the sash window assembly, thereby hindering movement of the lower sash. Such an arrangement has the disadvantages that, on the one hand, the contact region wears after a period of use and so the lower sash is no longer securely held and, on the other hand, that a two-handed operation of the locking mechanism is required.

A major disadvantage with sash type windows is the difficulty in obtaining a satisfactory seal between the frames of the sashes themselves and the window frame when the window is in its closed position. Such a seal is important to prevent draughts. Thus, it is an object of the present invention to provide a locking mechanism for sash windows in which a better seal is obtained when the window is in its closed position, and which can be operated with one hand.

SUMMARY OF THE INVENTION

This object is attained by a locking mechanism of the type identified in the introduction of the description in which the locking mechanism is operable by a handle which, when the locking mechanism is in a locked mode and the sashes are in the closed position, causes at least one sash clamp to engage a cooperating receiving element affixed to the adjacent rail of the other sash, and further effects the contact of a locking bolt at either end of the transverse rail against side walls of a window sash guide groove in a window frame enclosing said upper and lower sashes and which handle, when the locking mechanism is in an open mode, causes the locking bolts to release the contact with the groove's side walls, whilst still remaining within the groove and further causes the sash clamp to disengage from its receiving element.

In a preferred embodiment of the invention, the contacting surfaces of the sash clamp and its corresponding receiving element are so shaped that, upon engagement of the sash clamp with the receiving element, the upper transverse rail of the lower window sash is drawn towards the adjacent rail of the other sash. This effects a better seal between the said rails of the window sashes.

Similarly, in another embodiment the contacting surfaces of the sash clamp and its corresponding receiving element are so shaped that, upon engagement of the sash clamp with the receiving element, the upper sash is vertically upwardly displaced with respect to the lower sash. Such displacement ensures a better seal between the sash frames and the window frame.

The movement of the locking bolts between the open and locked mode may be effected by a cam element for each locking bolt causing rotation of the locking bolts about a respective pivot point within the locking mechanism.

Advantageously, each cam element is operated via a connecting rod to which said sash clamp is attached for movement between the open and locked position.

Preferably, the movement of the handle is transmitted to the cam elements and sash clamp via respective sash clamp actuator rods connected to respective flanges on a first disk rotated by said handle.

The locking mechanism according to the invention may also be provided with a third operating mode in which the locking bolts are fully retracted from the guide groove to permit the lower sash to be moved in a non-vertical plane. Thus, the lower sash can be swung inwardly to allow easier access for cleaning of the sash.

Advantageously, said retraction of the locking bolts is effected by respective lock pin actuator rods connected to respective flanges on a second disk rotated by said handle.

In a preferred embodiment said first and second disks are arranged for independent rotation about a spindle of said handle, each disk being provided with a shaped opening for the accommodation of a correspondingly shaped spigot formed on said spindle. Preferably, when the locking mechanism is in its locked mode, these openings in the disks are offset by a certain angle whilst, in the open mode, these openings are aligned.

In order to switch from the open mode to the third mode, the spigot on the spindle of the handle may be displaced along the axis of the spindle so that the spigot engages with said second disk, said handle then being rotated to cause the retraction of the locking bolts via the respective locking bolt actuator rods.

In a further preferred embodiment the lower sash can be locked in any open position by causing said locking bolts to contact said side surface of the window frame groove by rotation of said handle to switch the locking mechanism from the open mode to the locked mode.

The present invention will be more fully described in the following by way of example only with reference to the attached drawings.

DETAILED DESCRIPTION OF A PREFERRED EMBODIMENT

Figure 1:
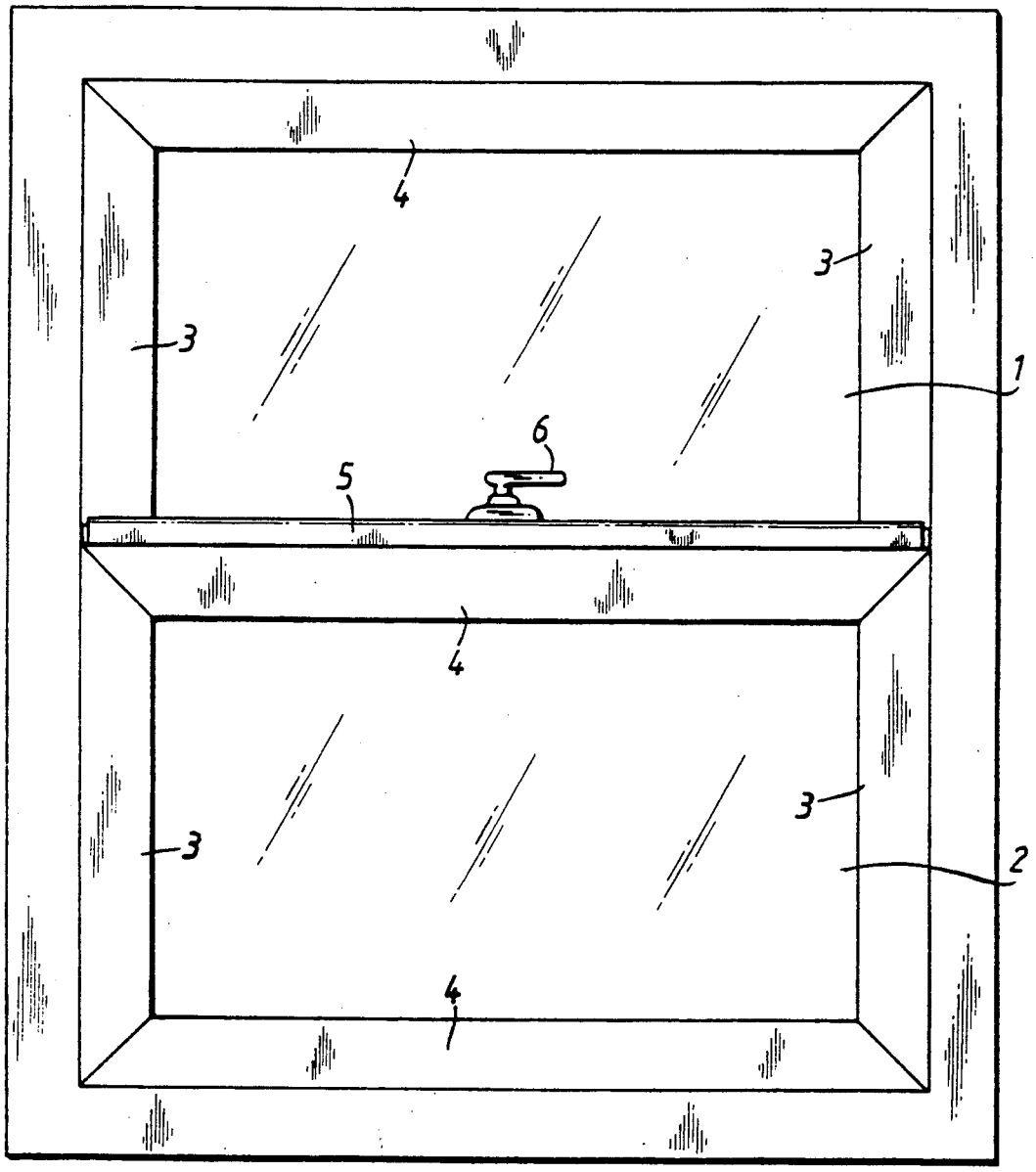
FIG. 1 is a schematic perspective view of a sash window assembly provided with a locking mechanism according to the present invention.
Figures 3, 3A, 3B, 4, 5:
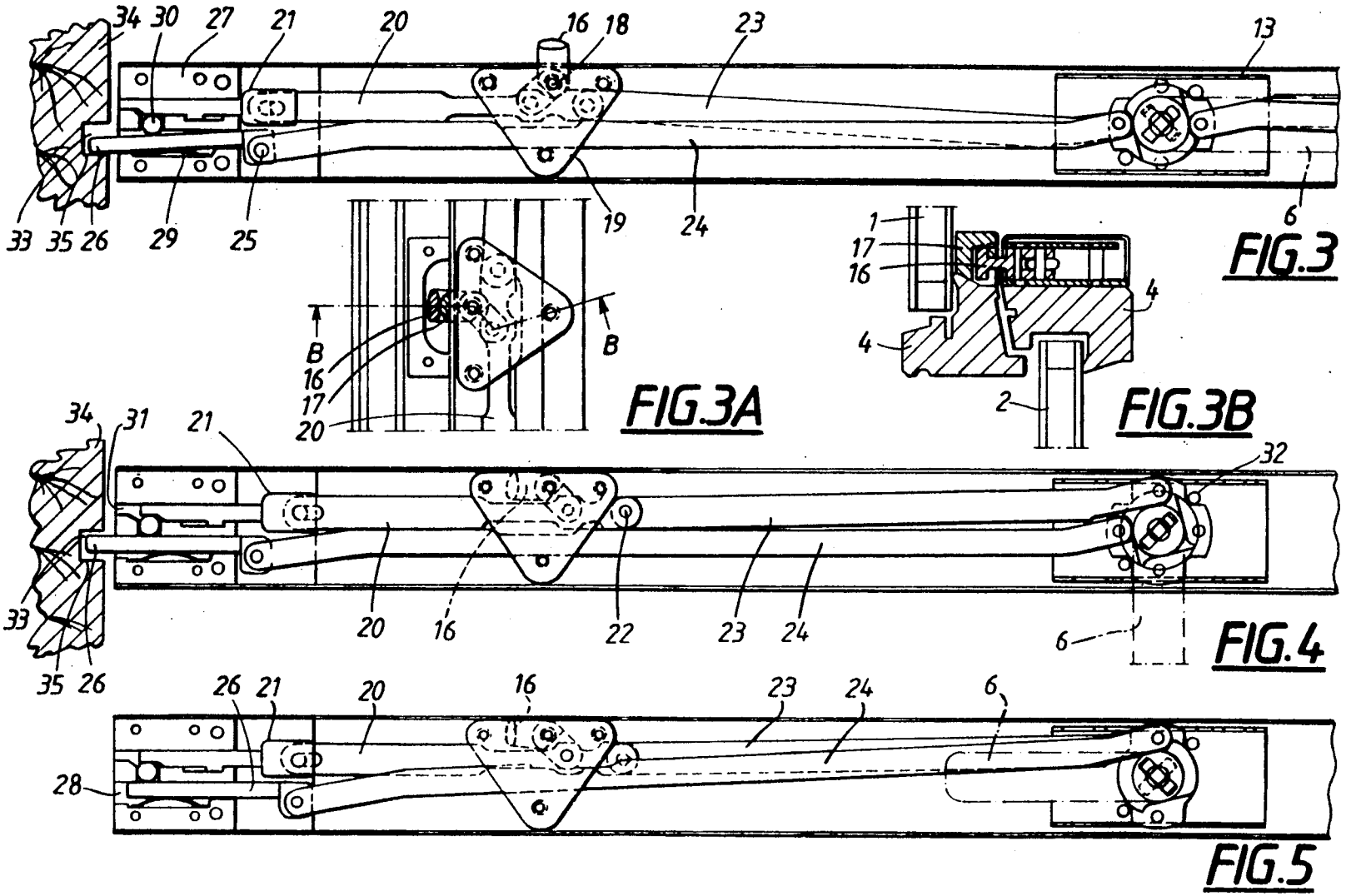
FIG. 3 is a plan view of the locking mechanism without its top cover and in its locked mode.
FIG. 3*a* is a plan view of a part of the locking mechanism in engagement with the adjacent sash.
FIG. 3*b* is a section along line B—B of FIG. 3*a;*
FIG. 4 is a plan view similar to FIG. 3, but with the locking mechanism in its open mode.
FIG. 5 is a plan view of the locking mechanism in its third mode.

Referring to FIG. 1, the upper and lower sliding sashes of a window assembly are indicated by the reference numerals 1 and 2 respectively, each sash being enclosed by a frame composed of side rails 3,3 and transverse rails 4,4, the top and bottom transverse rails of the lower and upper sashes respectively forming the meeting rail of the respective sash which, when the sashes are in the closed position, abuts the adjacent rail on the other sash, as best seen in FIG. 3*b*.

The locking mechanism according to the present invention is attached to the top surface of the transverse rail 4 of the lower sash 2. The mechanism is housed in a substantially rectangular casing 5 and is operated by a handle 6. In the drawings the handle is shown centrally mounted on the mechanism, with the mechanism being symmetric about the centre line of the handle. For reasons of simplicity, only one half of the mechanism is shown in the remaining drawings. However, it is to be understood that the handle need not to be centrally mounted but may be offset if circumstances so dictate.

Figure 2:
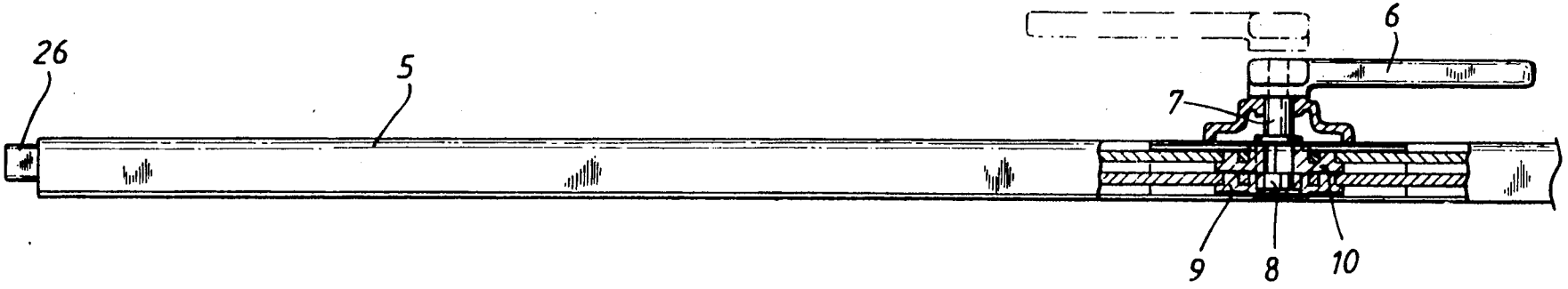
FIG. 2 is a partially sectioned view of the locking mechanism in its mounted state on the upper transverse rail of the lower window sash.
Figure 2B:
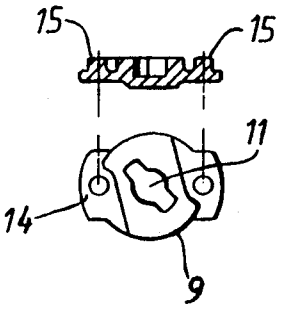
FIG. 2*b* is a plan view and cross section of a lower disk in the locking mechanism.
Figure 2A:
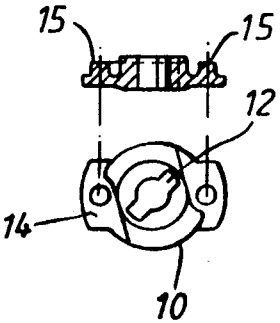
FIG. 2*a* is a plan view and cross section of an upper disk in the locking mechanism.

The handle arrangement is best shown in FIG. 2. A spindle 7 extends from the handle 6 into the casing 5 of the locking mechanism. A spigot 8 is provided at the end of the spindle 7 remote from the handle. The spigot 8 cooperates with either one of two adjacent disks 9,10 arranged for independent rotation with the spindle 7. The lower disk 9 has a recess or opening 11 to accommodate the spigot 8 and is rotatably supported in a handle housing 13 within the casing 5, whilst the upper disk 10 has a through-opening 12 to accommodate the spigot 8 and is rotatably supported by the lower disk 9. Each disk is slightly thicker than the height of the spigot 8.

Each disk has the same circumferential form, i.e. substantially circular with two diametrically opposed, radially outwardly extending flanges 14. When the disks 9,10 are superimposed, their openings 11,12 are offset by 90°.

A vertical pin 15 is formed on each flange 14 on the line of symmetry bisecting the disks 9,10. These pins cooperate with elements of the locking mechanism for controlling the respective functions of the mechanism as described in the following.

The locking mechanism has three modes of operation, i.e. a locked mode, an open mode and a "cleaning" mode respectively.

With reference to FIGS. 3, 3*a* and 3*b*, two sash clamps 16 are provided, one on either side of the handle arrangement. Since the locking mechanism is symmetric about the handle arrangement, only the left-hand half of the mechanism as shown in the drawings will be described in the following. In the shown locked position, the sash clamp 16 firmly engages a receiving element 17 mounted on the top surface of the lower transverse rail 4 of the upper sash 1.

As best shown in FIG. 3*a*, the contacting surfaces of the sash clamp and receiving element are so shaped that, upon engagement of the sash clamp with the receiving element, the upper transverse rail of the lower window sash is drawn towards the adjacent rail of the other sash.

As best shown in FIG. 3*b*, the upper contacting surface of the sash clamp and the respective surface of the receiving element are so shaped that, upon engagement of the sash clamps with the receiving element, the upper sash is slightly vertically displaced with respect to the lower sash.

Seen from above, the sash clamp 16 is dog-leg shaped and is made to pivot about a vertical pivot pin 18 passing through the mid point of the dog-leg. The pivot pin 18 is attached at its lower end to the base of the casing 5, whilst its upper end is located in a horizontally disposed pivot pin locating plate 19 within the casing 5.

Sash clamp 16 is pivotably attached to a connecting rod 20 which extends in a horizontal plane parallel to the casing 5. One end of the connecting rod 20 is connected to a cam element whilst its other end is connected via a pivot link 22 to one end of a sash clamp actuator rod 23. The other end of the sash clamp actuator rod 23 is pivotably attached to the vertical pin formed on the flange 14 of the lower disk 9.

An actuator rod 24 is similarly connected to the vertical pin of the upper disk 10. This rod 24 extends horizontally and terminates with a pivot link 25. Connected to this pivot link is a locking bolt 26.

In the locked mode as shown in FIG. 3, the lower and upper disks 9,10 are so arranged that the vertical pins 15 on the flanges 14 lie on a common vertical axis, equidistant from the vertical side walls of the casing 5.

Both the cam element 21 and the locking bolt 26 are supported by a guide block 27 at the extreme end of the locking mechanism cover. Locking bolt 26, via a through-passage 28, passes through said guide block 27 and protrudes into a groove 33 in the vertical elements 34 of the window frame enclosing the two sash windows. For reasons of clarity, the groove and vertical element shown in the drawings are merely schematic representations on a larger scale than the rest of the locking mechanism. In actual practice, the clearences around the locking bolt are very much smaller than shown. To reduce wear, the groove may be provided with some form of lining. The through-passage 28 is so shaped that the locking bolt 26 is allowed to rotate through several degrees about the pivot link 25 on the actuator rod 24. This pivotal movement is resisted by a spring member 29 in the through-passage 28.

In the locked position as shown in FIG. 3, the locking bolt 26 is forced against the spring member 29 into a position where the bolt 26 engages the side wall 35 of the groove in the vertical element of the window frame. The reaction between the locking bolt 26 and the groove side wall 35 pushes the lower sash 2 towards the upper sash 1, thereby effecting a better seal between the transverse rails 4,4 of these sashes.

Locking bolt 26 is forced into its locked position by means of the cam element 21 acting on a roller or ball-bearing 30 located in the guide block 27 in a connecting passage between the locking bolt through-passage 28 and a through-passage 31 for the cam element 21. The position of the cam element is controlled by the sash clamp actuator rod 23. Thus, when the sash clamp 16 is in its outwardly extended (e.g. locked) position, the cam element 21 acts on the roller 30 to force the locking bolt 26 into its locked position. Since the sash clamp 16 and the locking bolt 26 are operated substantially simultaneously via the handle 6, a more even distribution of forces around the sash frame when the mechanism is in its locked mode is achieved.

In the locked mode, the spigot 8 on the spindle 7 of handle 6 rests in the opening 11 of the lower disk 9. To move the locking mechanism to its open position, handle 6 is turned through 90° to the position shown in FIG. 4.

The displacement of the handle 6 is transmitted via the spindle 7 and spigot 8 to lower disk 9. After 90° of rotation, the disk's movement is blocked by stop pins 32 mounted in the handle-housing 13 abutting the flanges 14 on the disk. As shown in the figures, sash clamp actuator rod 23 is thereby drawn to the right and sash clamp 16 is rotated through 90° to disengage from its receiving elements 17 due to displacement of the connecting rod 20.

The attachment between the connecting rod 20 and the cam element 21 is such that the connecting rod 20 is allowed independent movement for the first part of its travel, with the cam element being engaged only for the latter movement. This latter movement withdraws cam element 21 to a position whereat the roller or ball-bearing 30 can partially project into the through-passage 31 of the cam element 21. Due to the action of the spring member 29 on the locking bolt 26, in this position the locking bolt 26 lies between the side walls of the grooves in the window frame, thereby no longer hindering movement of the lower sash 2 with respect to the window frame. Thus, the lower sash 2 may now be raised to open the window.

The lower sash 2 can be held in any desired open position by turning the handle 6 back to its locked position. Hereby the cam element 21 forces the locking bolt 26 against the action of the spring member 29 into its locked position against the side wall of the window frame groove. Naturally, the sash clamp 16 will also be moved to its locked position, though since the receiving element 17 does not move with the lower sash 2, the sash clamp 16 merely projects towards the upper sash 1.

Should the displacement of the lower sash 2 wish to be restricted, e.g. to allow a gap which is too small for children to climb through, releasable blocking pieces can be inserted into the window frame grooves at the appropriate height to prevent the lower sash 2 passing these blocking pieces.

The final mode of operation of the locking mechanism is the so-called cleaning mode. In this mode, the lower sash 2 can be swung away from the window frame to allow its outer surface to be cleaned from the inside. This mode is shown in FIG. 5.

When the window is closed, e.g. when sash clamp 16 is cooperable with its receiving element 17, and the locking mechanism is in its open mode, the handle 6 is lifted so that spigot 8 passes from the lower disk 9 into the through-opening 12 of the upper disk 10. The handle 6 is then turned through 90°, effecting rotation of the upper disk 10, but not the lower disk 9. Lock pin actuator rod 24 is hereby moved to the right as shown in the figures, thereby drawing the locking bolt 26 fully into the guide block 27. Since there is no part of the lock mechanism or the lower sash 2 which now projects into the window frame groove, the lower sash is no longer restricted to movement solely in a vertical plane. By means of a not shown hinge arrangement, the lower sash may be pivoted about the transverse rail 4 of the upper sash 1.

It is to be understood that the present invention is not restricted to the above-described embodiment, but may be varied within the scope of the appended claims. For example, the sash clamps may be more or less than two in number. Similarly, pairs of sash clamps may be provided with one sash clamp arranged above the other, with the surfaces of the clamps facing away from each other cooperating with surfaces of a receiving element to effectively double the clamping force between the two sashes. Furthermore, the different modes of the locking mechanism need not be operable by 90° stepwise displacement of the handle; other angles may be chosen provided that the through-openings of the disks coincide in the open mode.

What is claimed is:

1. A locking mechanism for a window having a window frame including a guide groove extending in movement directions, and upper and lower sashes at least one of which is slidable with respect to said frame in said movement directions, each of said sashes having a meeting rail, said meeting rails adapted to lie adjacent one another when said sashes are in a closed position, said locking mechanism comprising at least one sash clamp connected to one of said meeting rails, at least one receiving element corresponding to said at least one sash clamp connected to the other of said meeting rails, a locking element disposed at an end of said one of said meeting rails and adapted in an extended position to lie within said guide groove, a handle moveable between a locked position, an unlocked position and a release position, and an operating mechanism including means for engaging said locking element with a wall of said guide groove and for engaging said at least one sash clamp with said at least one receiving element responsive to movement of said handle from said unlocked position to said locked position, said operating mechanism also including means for disengaging said locking element from said wall of said guide groove and for disengaging said at least one sash clamp from said at least one receiving element responsive to movement of said handle from said locked position to said unlocked position, said operating mechanism further including means for retracting said locking element from within said guide groove responsive to movement of said handle from said unlocked position to said release position.

2. The locking mechanism as claimed in claim 1, wherein said at least one sash clamp has a first contacting surface and said at least one receiving element has a first engagement surface, said first contacting surface and said first engagement surface being sized and shaped so that, upon engagement of said at least one sash clamp with said at least one receiving element, said meeting rails are drawn toward one another in directions transverse to said movement directions.

3. The locking mechanism as claimed in claim 2, wherein said at least one sash clamp includes a second contacting surface and said at least one receiving element includes a second engagement surface, said second contacting surface and said second engagement surface being sized and shaped so that, upon engagement of said at least one sash clamp with said at least one receiving element, said upper sash and said lower sash are displaced away from one another in opposite movement directions.

4. The locking mechanism as claimed in claim 1, wherein said at least one sash clamp includes a second contacting surface and said at least one said receiving element includes a second engagement surface, said second contacting surface and said second engagement surface being sized and shaped so that, upon engagement of said at least one sash clamp with said at least one receiving element, said upper sash and said lower sash are displaced away from one another in opposite movement directions.

5. The locking mechanism as claimed in claim 1, wherein said operating mechanism further includes first and second intermediate elements, said handle being selectively engageable to move either of said intermediate elements, said operating mechanism including first actuating means for engaging and disengaging said locking element with said wall of said guide groove and for engaging and disengaging said at least one sash clamp with said at least one receiving element responsive to movement of said first intermediate element, said operating mechanism also including second actuating means for retracting said locking element from within said guide groove and for extending said locking element into said guide groove responsive to movement of said second intermediate element.

6. The locking mechanism as claimed in claim 5, wherein said locking element is pivotable with respect to said one of said meeting rails, and wherein said first actuating means includes pivoting means for pivoting said locking element responsive to movement of said first intermediate element.

7. The locking mechanism as claimed in claim 6, wherein said first actuating means includes a connecting rod operatively connecting said at least one sash clamp with said pivoting means.

8. The locking mechanism as claimed in claim 7, wherein said first actuating means further includes a sash clamp actuator rod operatively connecting said first intermediate element with said connecting rod.

9. The locking mechanism as claimed in claim 6, wherein said first actuating means further includes a sash clamp actuator rod operatively connecting said first intermediate element with said connecting rod.

10. The locking mechanism as claimed in claim 5, wherein said second actuating means includes a lock pin actuator rod operatively connecting said second intermediate element with said locking element.

11. The locking mechanism as claimed in claim 6, wherein said second actuating means includes a lock pin actuator rod operatively connecting said second intermediate element with said locking element.

12. The locking mechanism as claimed in claim 11, wherein said locking element is pivotally mounted to said lock pin actuator rod, and wherein said second actuating means includes means for extending said lock pin actuator rod towards said guide groove and for retracting said lock pin actuator rod away from said guide groove responsive to movement of said second intermediate element.

13. The locking mechanism as claimed in claim 5, wherein said handle includes a spindle having a shaped member formed thereon, and wherein said first intermediate element includes an opening sized and shaped to matingly receive said shaped member upon the selective engagement of said handle with said first intermediate element, and wherein said second intermediate element includes an opening sized and shaped to matingly receive said shaped member upon the selective engagement of said handle with said second intermediate element.

14. The locking mechanism as claimed in claim 13, wherein said opening in said first intermediate element is oriented in a first rotational direction and said opening in said second intermediate element is oriented in a second rotational direction, said second rotational direction being different than said first rotational direction by a predetermined angle when said handle is in said locked position, and said second rotational direction being substantially equal to said first rotational direction when said handle is in said unlocked position.

15. The locking mechanism as claimed in claim 1, wherein rotation of said handle from said unlocked position to said locked position causes said locking element to engage said wall of said guide groove, whereby said sash having said one of said meeting rails can be locked in an open position.

16. The locking mechanism as claimed in claim 1, wherein said window frame has a second guide groove, further comprising a second locking element disposed at another end of said one of said meeting rails and adapted in an extended position to lie within said second guide groove, and said operating mechanism including means for engaging and disengaging said second locking element with a wall of said second guide groove responsive to movement of said handle between said unlocked position and said locked position, said operating mechanism also including means for retracting said second locking element from within said second guide groove and for extending said second locking element into said second guide groove responsive to movement of said handle between said unlocked position and said release position.

17. The locking mechanism as claimed in claim 5, wherein said window frame has a second guide groove, further comprising a second locking element disposed at another end of said one of said meeting rails and adapted in an extended position to lie within said second guide groove, and said operating mechanism including third actuating means for engaging and disengaging said second locking element with a wall of said second guide groove responsive to movement of said first intermediate element, said operating mechanism also including fourth actuating means for retracting said second locking element from within said second guide groove and for extending said second locking element into said second guide groove responsive to movement of said second intermediate element.

18. The locking mechanism as claimed in claim 17, wherein said second locking element is pivotable with respect to said one of said meeting rails, and wherein said third actuating means includes pivoting means for pivoting said second locking element responsive to movement of said first intermediate element.

19. The locking mechanism as claimed in claim 18, wherein said fourth actuating means further includes a second lock pin actuator rod operatively connecting said second intermediate element with said second locking element.

20. The locking mechanism as claimed in claim 16, wherein rotation of said handle from said unlocked position to said locked position causes said second locking element to engage said wall of said second guide groove, whereby said sash having said one of said meeting rails can be locked in an open position.

* * * * *

UNITED STATES PATENT AND TRADEMARK OFFICE

CERTIFICATE OF CORRECTION

PATENT NO. : 5,090,750

DATED : February 25, 1992

INVENTOR(S) : Lindqvist

It is certified that error appears in the above-identified patent and that said Letters Patent is hereby corrected as shown below:

Column 4, line 21, "element whilst" should read --element 21 whilst--.

Column 4, line 25, "formed" should read --15 formed--.

Column 4, line 27, "pin of" should read --pin 15 of--.

Column 4, line 29, "link is" should read --link 25 is--.

Signed and Sealed this

Fourth Day of May, 1993

Michael K. Kirk

MICHAEL K. KIRK

*Acting Commissioner of Patents and Trademarks*

*Attest:*

*Attesting Officer*